US010529307B1

(12) United States Patent
Chen

(10) Patent No.: US 10,529,307 B1
(45) Date of Patent: Jan. 7, 2020

(54) MULTI-PURPOSE DRUM

(71) Applicant: K.H.S. Musical Instrument Co., Ltd., New Taipei (TW)

(72) Inventor: Bo-Ting Chen, New Taipei (TW)

(73) Assignee: K.H.S. Musical Instrument Co., Ltd., New Taipei (TW)

( * ) Notice: Subject to any disclaimer, the term of this patent is extended or adjusted under 35 U.S.C. 154(b) by 0 days.

(21) Appl. No.: 16/243,290

(22) Filed: Jan. 9, 2019

(30) Foreign Application Priority Data

Sep. 28, 2018 (TW) ..... 107134449 A

(51) Int. Cl.
*G10D 13/00* (2006.01)
*G10D 13/02* (2006.01)

(52) U.S. Cl.
CPC ..... *G10D 13/026* (2013.01); *G10D 13/027* (2013.01); *G10D 13/028* (2013.01)

(58) Field of Classification Search
CPC ... G10D 13/026; G10D 13/028; G10D 13/027
See application file for complete search history.

(56) References Cited

U.S. PATENT DOCUMENTS 9,754,567 B1 * 9/2017 Griffin ..... G10G 5/00
2019/0228747 A1 * 7/2019 Sikra ..... G10D 13/02

* cited by examiner

*Primary Examiner* — Kimberly R Lockett
(74) *Attorney, Agent, or Firm* — Huffman Law Group, PC

(57) ABSTRACT

A multi-purpose drum that can be assembled into a floor-tom, a bass drum, or a gong bass drum through different mating parts according to the performance requirements. This multi-purpose drum is lightweight, easy to carry, and quick to assemble.

10 Claims, 8 Drawing Sheets

MULTI-PURPOSE DRUM

CROSS-REFERENCE TO RELATED APPLICATIONS

The entire contents of Taiwan Patent Application No. 107134449, filed on Sep. 28 2018, from which this application claims priority, are expressly incorporated herein by reference.

BACKGROUND OF THE INVENTION

1. Field of the Invention

The present invention relates to a lightweight multi-purpose drum that is easy to carry and quick to assemble.

2. Description of Related Art

A standard modern drum kit, as used in popular music and taught in music schools, generally contains a snare drum, a bass drum, one or more toms, a hi-hat (two cymbals mounted on a stand), and one or more cymbals, such as crash cymbal, ride cymbal, etc.

Drum kits are typically heavy and consist of pieces that must be carried separately. Transportation of traditional drum kits usually requires a hatchback, truck, or van.

Taiwan Patent No. M298113 discloses a "multipurpose drum with structural improvement," which includes two shells (a first shell and a second shell) and three drumheads (a first, a second, and a third drumhead) mounted on the two shells. The first shell is connected with the second shell, and the first drumhead and the third drumhead can be replaced with a traditional drumhead, a practice drumhead, or an electronic drumhead according to requirements, so that the assembled drum can have different uses or sound.

SUMMARY OF THE INVENTION

In one general aspect, the present invention relates to a lightweight multi-purpose drum that is easy to carry and quick to assemble.

According to an preferred embodiment of this invention, a multi-purpose drum comprises a cylindrical shell having an upper opening and a lower opening, an upper drumhead for sealing the upper opening of the shell, an upper hoop for holding the upper drumhead on the shell, a detachable lower drumhead for sealing the lower opening of the shell, a detachable lower hoop for holding the lower drumhead on the shell, and three brackets fixed with an outer periphery surface of the shell. The multi-purpose drum further comprises three detachable floor tom legs, two detachable bass drum legs, a detachable supporting pedestal, and a detachable supporting frame. Each floor tom leg is optionally mounted to one of the three brackets to adapt the multi-purpose drum to a floor tom. Or, the shell is optionally pushed down, the two bass drum legs are optionally coupled with two of the three brackets, and the supporting pedestal is optionally coupled to the upper hoop to adapt the multi-purpose drum to a bass tom. Or, two of the three brackets are optionally coupled to the supporting frame, and the lower drumhead and the lower hoop are optionally detached from the shell to adapt the multi-purpose drum to a gong bass drum.

In one embodiment, each bracket comprises a base and a cover. The base is fixed with the shell. The cover is pivoted to the base, and the supporting frame, one of the three floor tom legs, or one of the two base drum legs is sandwiched between the base and the cover.

In one embodiment, the base comprises a pivot support having a pivot hole, a first groove, a fixing hole, and a cover-fixing member having a thread disposed in the fixing hole. The cover comprises an upper pivot support having an upper pivot hole and a lower pivot support having a lower pivot hole. The pivot support is located between the upper pivot support and the lower pivot support. The cover further includes a pivot shaft and a second groove. The pivot shaft passes through the upper pivot hole, the pivot hole, and the lower pivot hole. The second groove corresponds to the first groove, and the supporting frame, one of the three floor tom legs, or one of the two base drum legs is sandwiched between the first groove and the second groove. The cover further includes a through hole and a nut. The cover-fixing member passes through the through hole and engages with the nut.

In one embodiment, the nut is a wing nut.

In one embodiment, each bracket further comprises a spring disposed on a periphery of the cover-fixing member and disposed between the fixing hole and the cover.

In one embodiment, the multi-purpose drum further comprises a detachable cymbal support rod and a detachable cymbal, wherein when the multi-purpose drum is used as a bass drum, two of the three brackets are connected with the two bass drum legs, and the other third bracket is connected with the cymbal support rod, which then is connected with the cymbal.

In one embodiment, the cymbal support rod comprises a cymbal support fixing portion and a cymbal support bending portion, and wherein the cymbal support fixing portion is fixed with the corresponding bracket, and the cymbal support bending portion couples with the cymbal.

In one embodiment, the supporting pedestal comprises a foundation, a junction structure being connected with the foundation and being fixed with the upper hoop, and a connecting fastener being fixed with the junction structure.

In one embodiment, the upper hoop comprises a notch, and the supporting pedestal is embedded in the notch.

In one embodiment, each of the two bass drum legs comprises a straight portion and a bent portion. The straight portion is fixed with the corresponding bracket, and a terminal of the bent portion includes a tip to contact the ground.

DETAILED DESCRIPTION OF THE PREFERRED EMBODIMENT

Figure 1:
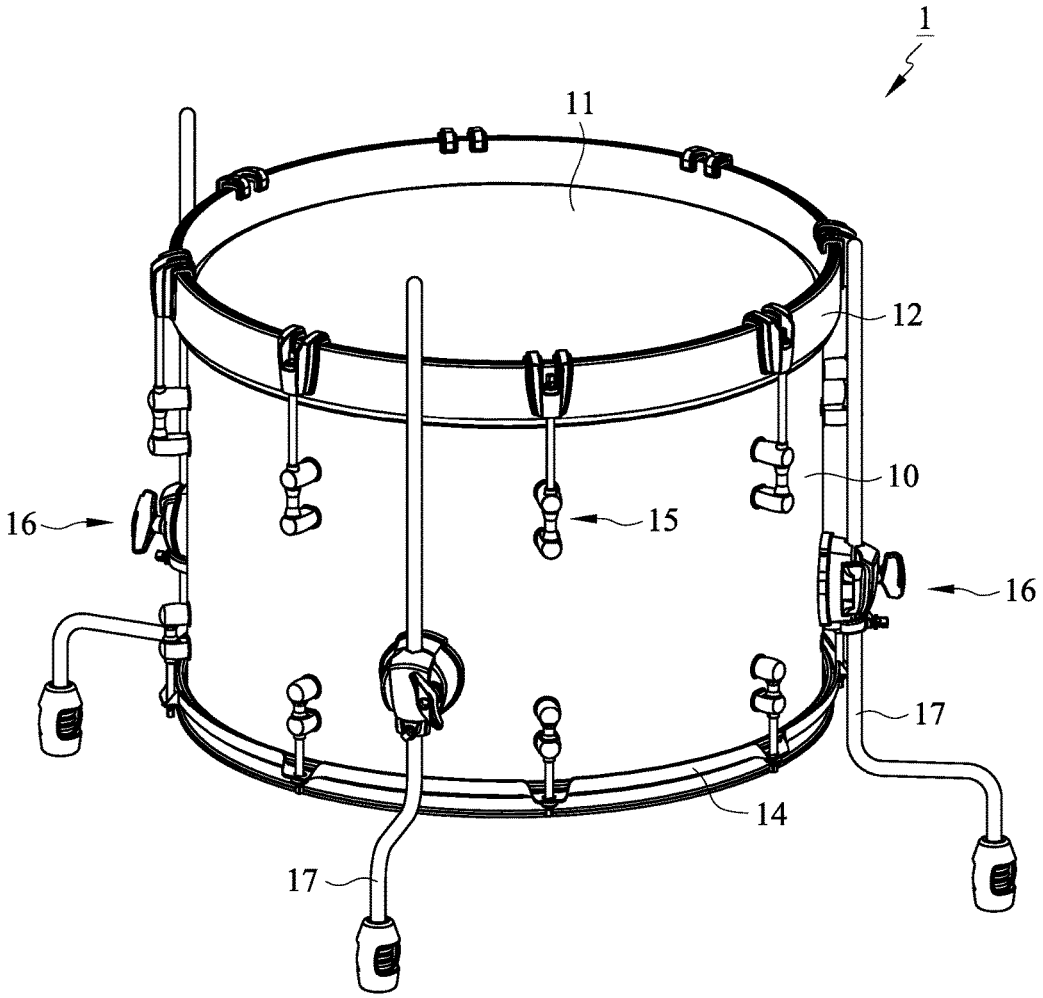
FIG. 1 is a perspective view of a multi-purpose drum provided in accordance with a preferred embodiment of the present invention, wherein the multi-purpose drum is used as a floor tom.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
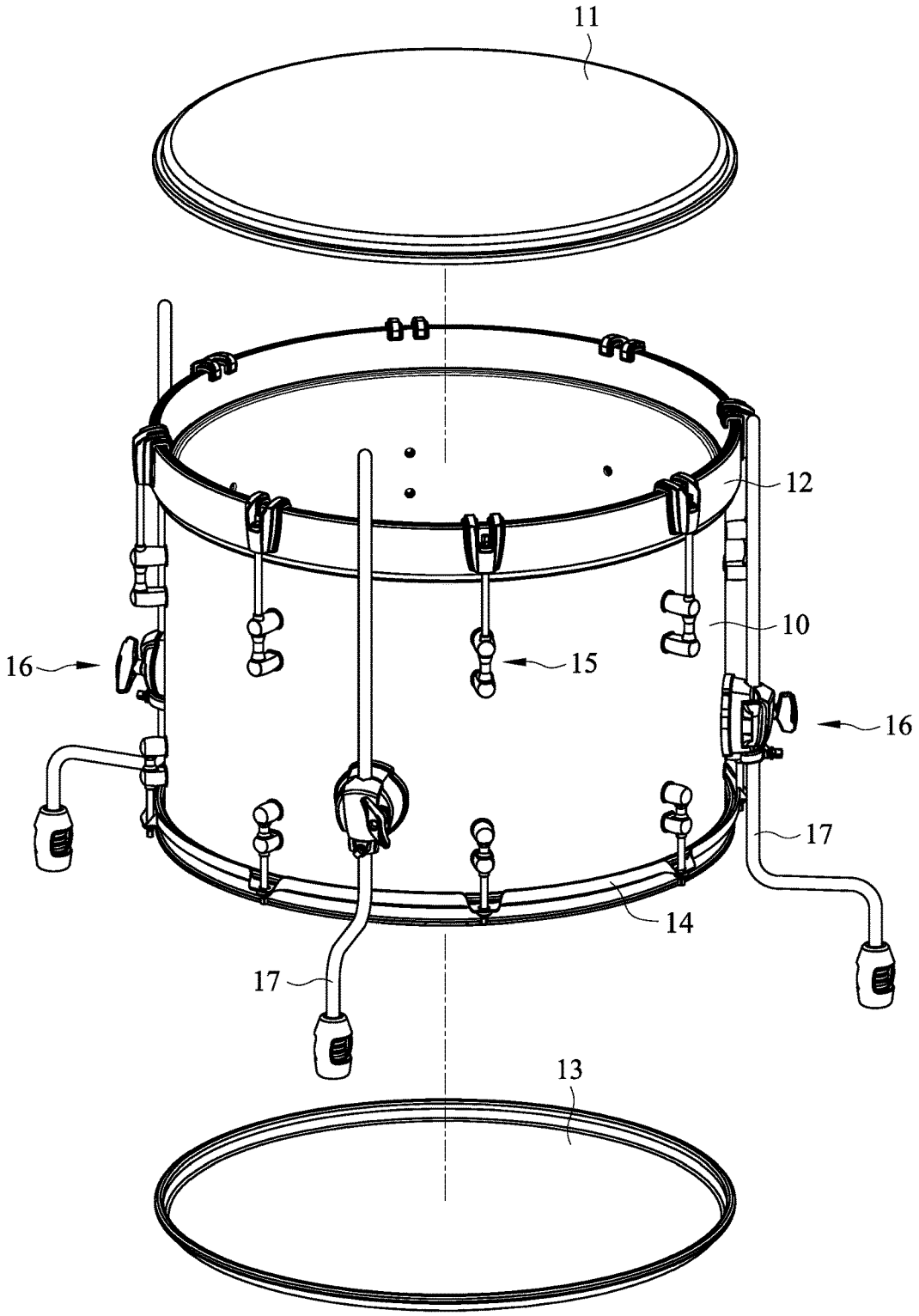
FIG. 2 is a schematic exploded view of the multi-purpose drum provided by the preferred embodiment of the present invention, wherein the multi-purpose drum is used as a floor tom.

FIG. 1 is a perspective view of a multi-purpose drum 1 provided by a preferred embodiment of the present invention, and FIG. 2 is a partial exploded view of the multi-purpose drum 1 provided by the preferred embodiment of the present invention. As shown in FIGS. 1 and 2, the multi-purpose drum 1 is used as a floor-tom.

As shown in FIGS. 1 and 2, the multi-purpose drum 1 mainly includes a shell 10, an upper drumhead 11, an upper hoop 12, a lower drumhead 13, a lower hoop 14, and a plurality of lug mechanisms 15. The shell 10 is a hollow cylinder having an upper opening and a lower opening. The upper drumhead 11 seals the upper opening of the shell 10. The upper hoop 12 is used to hold the upper drumhead 11 on the shell 10. The lower drumhead 13 seals the lower opening of the shell 10. The lower hoop 14 is used to hold the lower drumhead 13 on the shell 10. Some of the lug mechanisms 15 couple to the upper hoop 12 to adjust the tension of the upper drumhead 11, and the other lug mechanisms 15 couple to the lower hoop 14 to adjust the tension of the lower drumhead 13. The number of the lug mechanisms 15 can be determined by the size of the multi-purpose drum 1, and is not limited to the number shown in the drawings.

As shown in FIGS. 1 and 2, the multi-purpose drum 1 further includes a plurality of brackets 16 for connecting different detachable members, so that the multi-purpose drum 1 has different uses. In the present embodiment, preferably, the number of the brackets 16 is three. Each of the brackets 16 is connected with a floor tom leg 17, and hence the multi-purpose drum 1 can be used as a floor tom.

Figure 3:
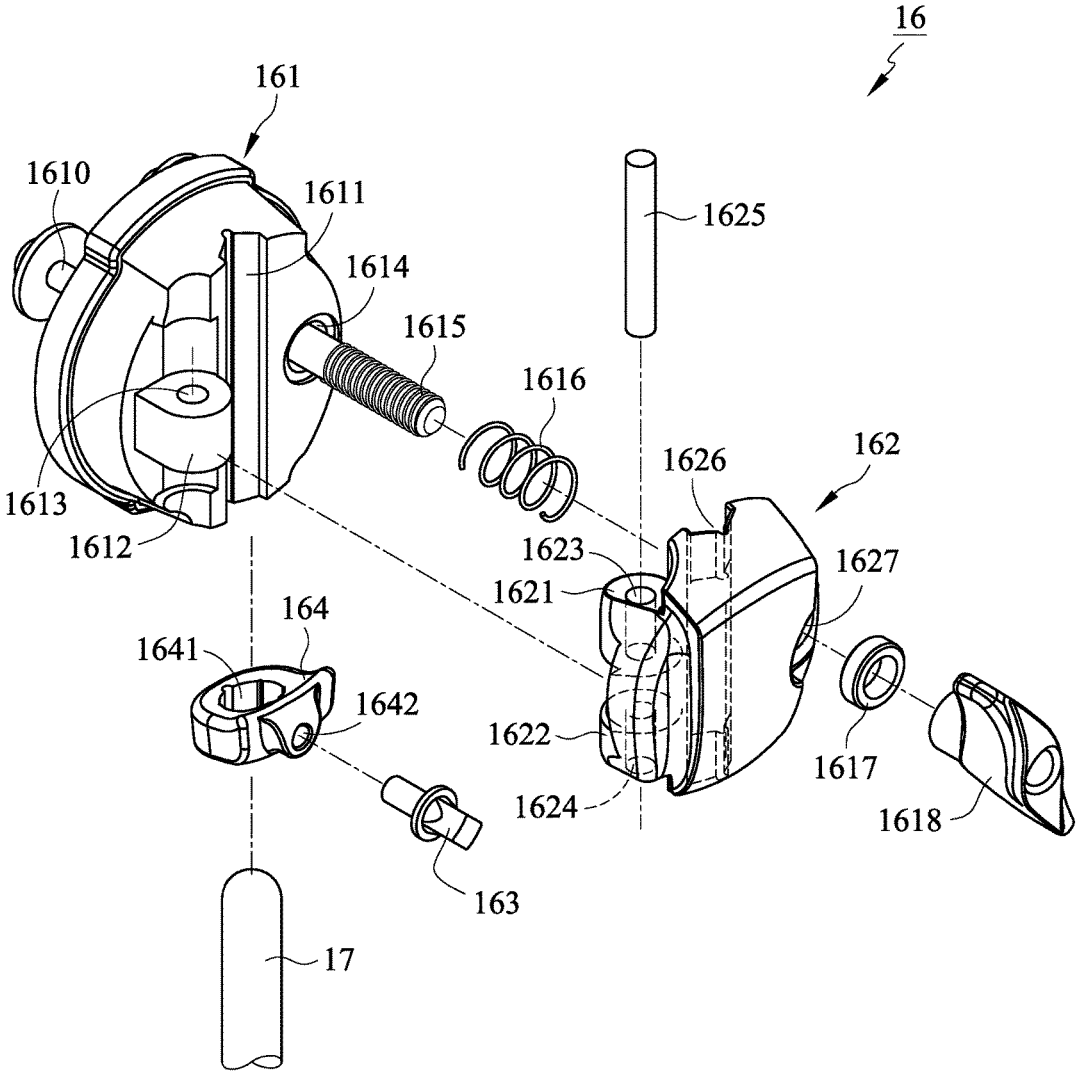
FIG. 3 is an exploded view of a bracket of the multi-purpose drum according to the preferred embodiment of the present invention.

FIG. 3 is an exploded view of the bracket 16 of the multi-purpose drum 1 according to the preferred embodiment of the present invention. As shown in FIG. 3, the bracket 16 includes a base 161 and a cover 162. The base 161 includes a plurality of base-fixing members 1610, a first groove 1611, and a pivot support 1612. The base-fixing members 1610 are used to mount the base 161 on the outer periphery surface of the shell 10. The base 161 includes the pivot support 1612. The cover 162 includes an upper pivot support 1621 and a lower pivot support 1622. The pivot support 1612 is disposed between the upper pivot support 1621 and the lower pivot support 1622. A pivot shaft 1625 passes through the upper pivot hole 1623 of the upper pivot support 1621, the pivot hole 1613 of the pivot support 1612, and the lower pivot hole 1624 of the lower pivot support 1622. Accordingly, the cover 162 can rotate about the pivot shaft 1625.

Referring to FIG. 3, in addition, the base 161 includes a fixing hole 1614 on a side away from the pivot support 1612, and a threaded cover-fixing member 1615 (for example, a bolt) is disposed in the fixing hole 1614. The cover-fixing member 1615 passes through the through hole 1627 of the cover 162 and then is in conjunction with a mating nut 1618. Preferably, the nut 1618 comprises, but is not limited to, a wing nut. A spring 1616, through which the cover-fixing member 1615 passes, is disposed between the fixing hole 1614 and the inner surface of the cover 162. A spacer 1617 may be further provided between the nut 1618 and the through hole 1627. When the nut 1618 is tightened with the cover-fixing member 1615, the cover 162 is mounted to the base 161. When the nut 1618 is loosened from the cover-fixing member 1615, the cover 162 is slightly bounced about the pivot shaft 1625 due to the bounce of the spring 1616.

Referring to FIG. 3, the base 161 further includes a first groove 1611, and the cover 162 has a corresponding second groove 1626. The bracket 16 can further include a memory holder 164 and a threaded drum leg memory fastener 163. The upper end (including the upper portion) of the floor tom leg 17 passes through the memory holder through hole 1641 of the memory holder 164, and the drum leg memory fastener 163 passes through a internally threaded memory holder fixing hole 1642 of the memory holder 164, so that the floor tom leg 17 can be fixed with the memory holder 164. Next, the upper end of the floor tom leg 17 is placed between the first groove 1611 of the base 161 and the second groove 1626 of the cover 162, and the nut 1618 is tightened with the cover-fixing member 1615 so that the floor tom leg 17 is fixed with the bracket 16.

Figure 4:
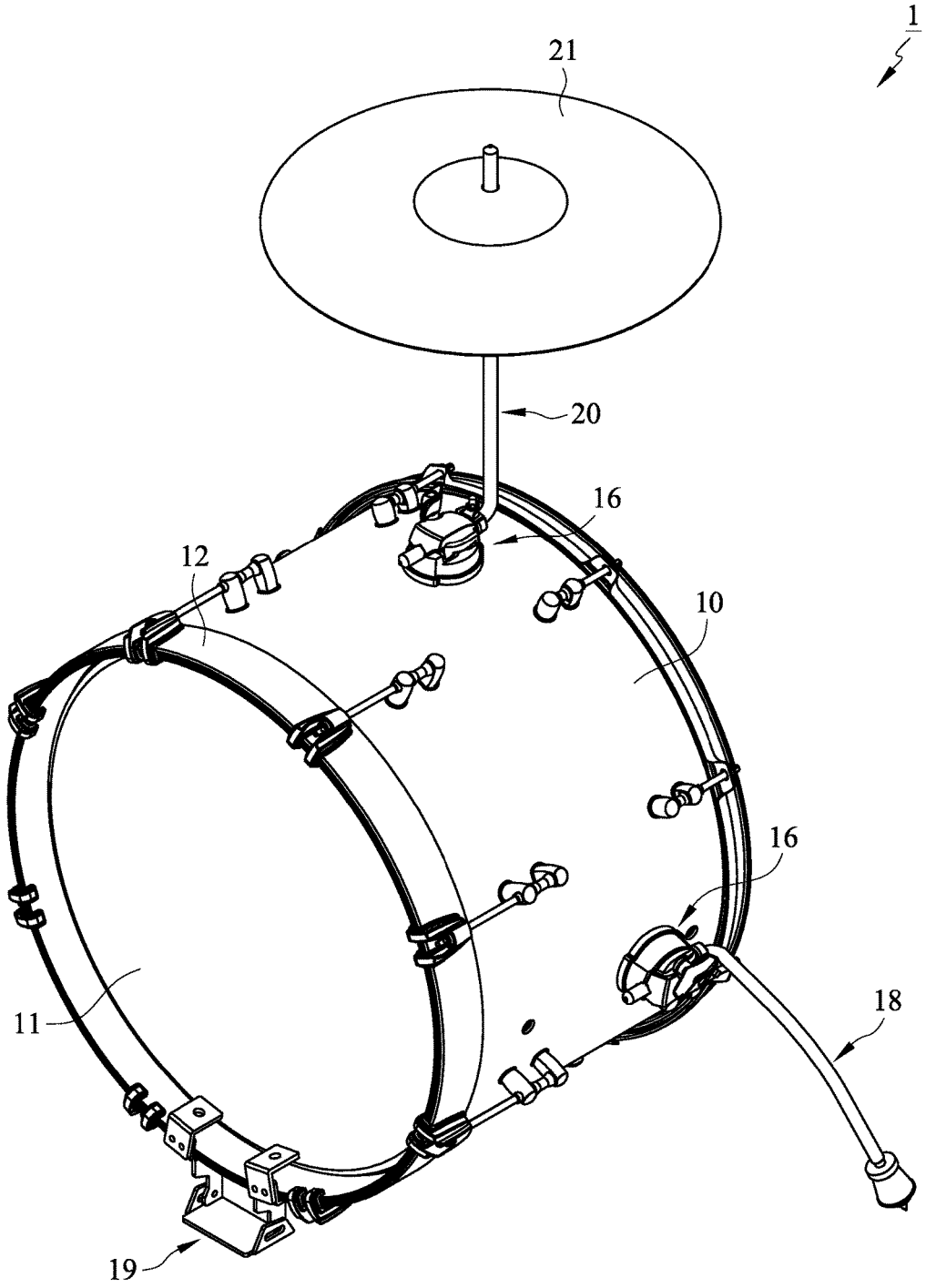
FIG. 4 is a perspective view of the multi-purpose drum provided by the preferred embodiment of the present invention, wherein the multi-purpose drum is used as a bass drum.
Figure 5:
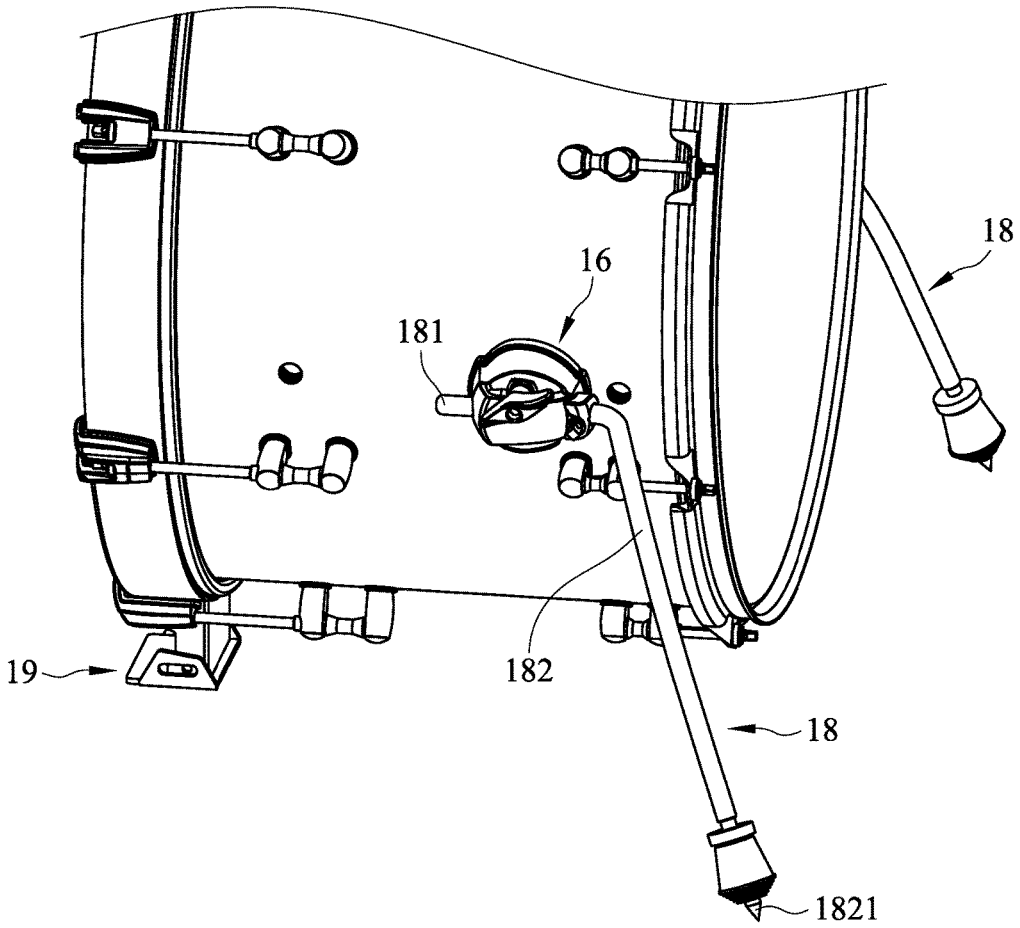
FIG. 5 is a partial perspective view of the multi-purpose drum provided by the preferred embodiment of the present invention, wherein the multi-purpose drum is used as a bass drum.
Figure 6:
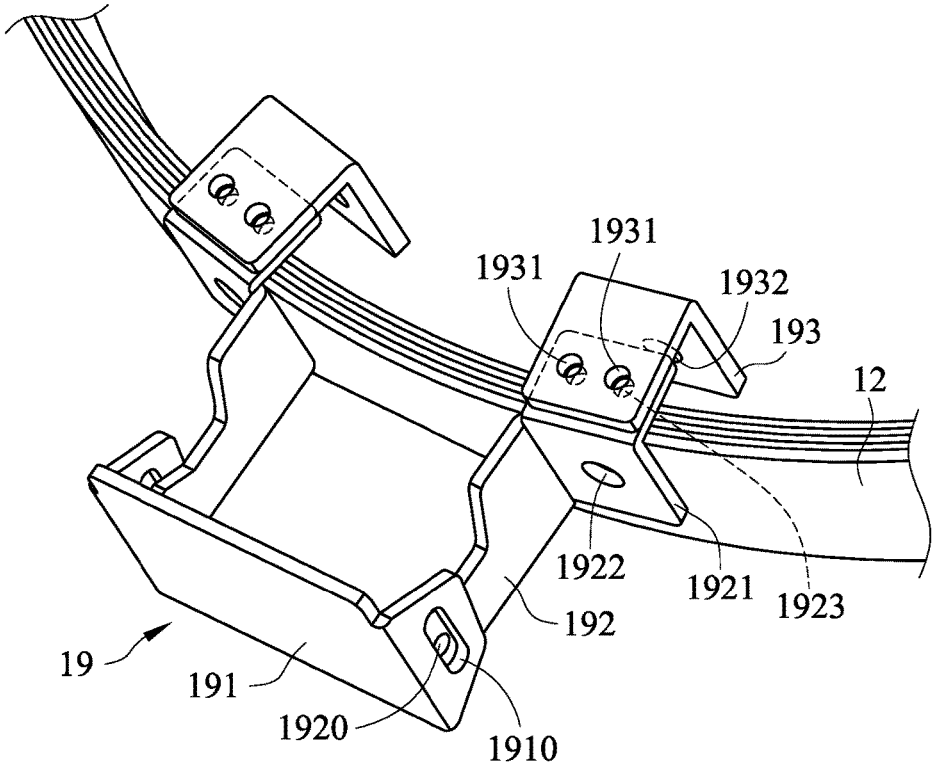
FIG. 6 is a partial perspective view of the multi-purpose drum provided by the preferred embodiment of the present invention, wherein the multi-purpose drum is used as a bass drum.
Figure 7:
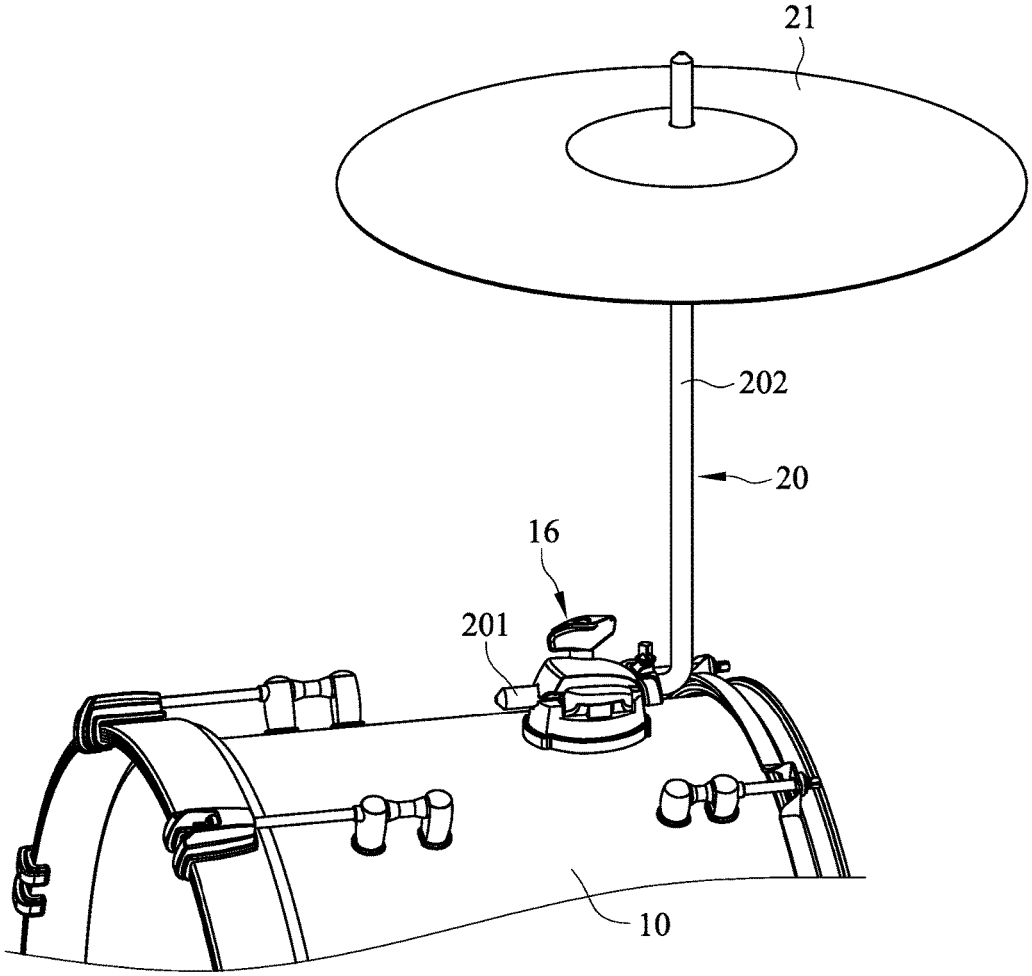
FIG. 7 is a partial perspective view of the multi-purpose drum provided by the preferred embodiment of the present invention, wherein the multi-purpose drum is used as a bass drum.

FIG. 4 is a perspective view of the multi-purpose drum 1 provided by the preferred embodiment of the present invention, wherein the multi-purpose drum 1 is used as a bass drum. FIGS. 5, 6, and 7 are partial perspective views of the multi-purpose drum 1 used as a bass drum in accordance with the preferred embodiment of the present invention.

Referring to FIGS. 4-7, the multi-purpose drum 1 further includes two detachable bass drum legs 18, a detachable supporting pedestal 19, a detachable cymbal support rod 20, and a detachable cymbal 21. When used as a bass drum, firstly the three floor tom legs 17 (FIG. 1) are removed from the three brackets 16. Next, the two bass drum legs 18 are connected with any two of the three brackets 16. The remaining one of the three brackets 16 is connected with the cymbal support rod 20, which is then connected with the cymbal 21. Next, the supporting pedestal 19 is mounted to the upper hoop 12 at a position opposite to the bracket 16 that couples with the cymbal support rod 20. Next, the shell 10 is pushed down so that the multi-purpose drum 1 comes into contact with the ground with the supporting pedestal 19 and the two bass drum legs 18. The above procedures can be changed in any order and are not limited to the order described.

Referring to FIGS. 4-7, in this embodiment, each bass drum leg 18 may have a straight portion 181 and a bent portion 182. The straight portion 181 is sandwiched between the first groove 1611 (FIG. 3) and the second groove 1626 (FIG. 3) of the bracket 16. A large bending angle, e.g., an angle exceeding 60 degrees, may be present between the straight portion 181 and the bent portion 182. A terminal of the bent portion 181 may form a tip 1821. Accordingly, when the multi-purpose drum 1 is used as a bass drum, the straight portion 180 is substantially parallel to the ground, and the tip 1821 of the bent portion 181 is in contact with the ground for increasing the grip strength.

Referring to FIGS. 4-7, in this embodiment, the supporting pedestal 19 includes a foundation 191, a junction structure 192, and a connecting fastener 193. The supporting pedestal 191 is substantially U-shaped and comprises two side walls, with each side wall including a foundation-fixing hole 1910. The junction structure 192 also includes two side walls with each including a side-fixing hole 1920 corresponding to one foundation-fixing hole. A fixing member (not shown) passes through the foundation-fixing hole 1910 and the side-fixing hole 1920 to fix the foundation 191 and the junction structure 192.

In addition, each side wall of the junction structure 192 includes an L-shaped upper bent portion 1921. One surface of the L-shaped upper bent portion 1921 is attached to the outer surface of the upper hoop 12, and a fixing member (not shown) is passed through a hoop-fixing hole 1922 to fix the junction structure 192 and the upper hoop 12. The other surface of the L-shaped upper bent portion 1921 is attached to the upper edge surface of the upper hoop 12 and has two connection-fixing holes 1923. The connecting fastener 193 is substantially L-shaped and includes a surface parallel to the inner side of the upper hoop 12, and the surface includes a hoop hole 1932. A fixing member (not shown) passes through the hoop hole 1932 to fix the connecting fastener 193 with the upper hoop 12. The other surface of the connecting fastener 193 includes two connection-fixing holes 1931 corresponding to the two connection-fixing holes 1923 of the junction structure 192. A fixing member (for example, a rivet, not shown) passes through the connection-fixing hole 1931 and the connection-fixing hole 1923 to fix the junction structure 192 and the connecting fastener 193. In another embodiment of the invention, the upper hoop 12 includes a notch (not shown), and the supporting pedestal 19, or the junction structure 192 of the supporting pedestal 19, is embedded into the notch. In this case, the bracket 16 facing the notch is the one used for connecting the cymbal support rod 20. Such design is convenient for the drummer to quickly assemble. In another embodiment of the present invention, the junction structure 192 and the connecting fastener 193 are not fixed with the upper hoop 12 by the fixing members. Instead of using the fixing members, the upper hoop 12 is sandwiched between the junction structure 192 and the connecting fastener 193 by fitting. Such design is more advantageous for quick assembly.

Referring to FIGS. 4-7, in this embodiment, the cymbal support rod 20 may include a cymbal support fixing portion 201 and a cymbal support bending portion 202. The cymbal support fixing portion 201 is sandwiched between the first groove 1611 (FIG. 3) and the second recess 1626 (FIG. 3) of the bracket 16. A large bending angle, e.g., an angle ranging from 60 degrees to 90 degrees, is present between the cymbal support fixing portion 201 and the cymbal support bending portion 202. When the multi-purpose drum 1 is used as a bass drum, the cymbal support fixing portion 201 is substantially parallel to the ground, and the cymbal support bending portion 202 is substantially vertically disposed, allowing the drummer to easily hit the cymbal 21 with a stick. In another embodiment of the present invention, when the multi-purpose drum 1 is used as a bass drum, the cymbal support rod 20 and the cymbal 21 may not be installed.

Figure 8:
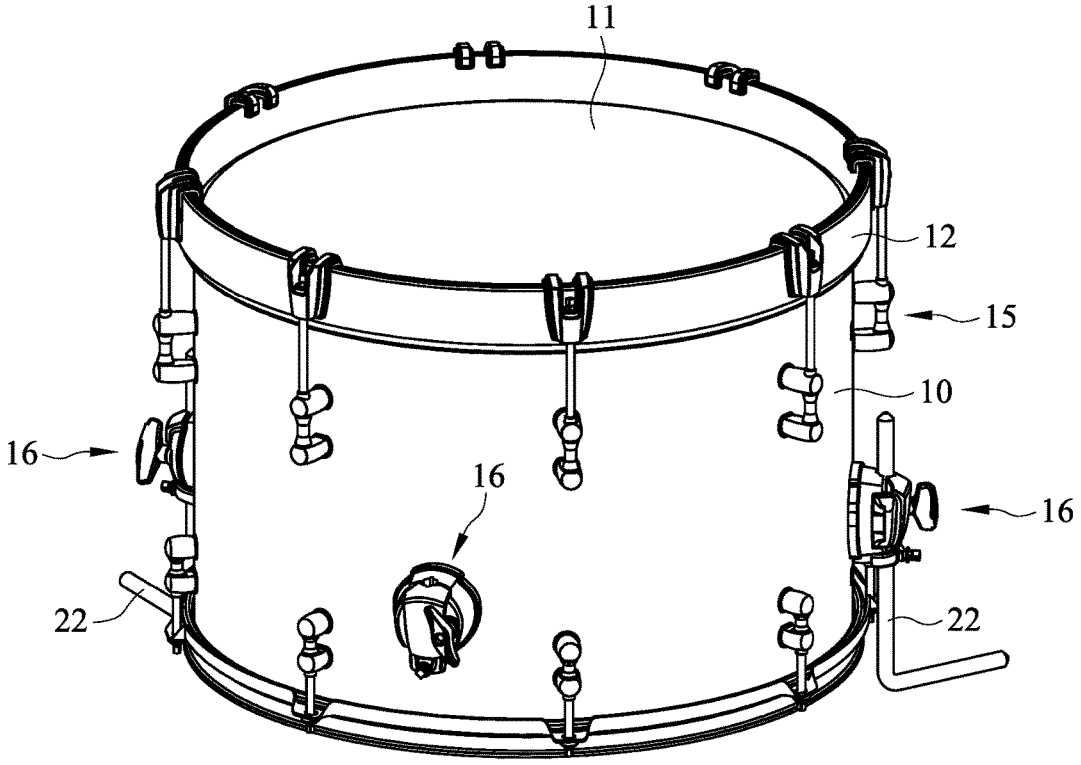
FIG. 8 is a perspective view of the multi-purpose drum provided by the preferred embodiment of the present invention, wherein the multi-purpose drum is used as a gong bass drum.

FIG. 8 is a perspective view of a multi-purpose drum 1 provided by the preferred embodiment of the present invention, wherein the multi-purpose drum 1 is used as a gong bass drum.

Referring to FIG. 8, when the multi-purpose drum 1 is to be used as a gong bass drum, firstly, any two of the three brackets 16 are connected with the supporting frame 22 (only a part of the supporting frame has been shown in FIG. 8). In another embodiment, the three brackets 16 respectively couples to a floor tom leg, e.g., but is not limited to, the floor tom leg 17 shown in FIG. 1. Thereby, the gong bass drum stands on the ground through the supporting frame 22 or the floor tom legs. In addition, the lower hoop 14 and the lower drumhead 13 are detached from the drum 1. The above procedures can be changed in any order and are not limited to the order described. In other embodiments of the invention, the gong bass drum can have other mounting options. For example, two brackets 16 can be used to mount the gong bass drum on two supporting legs.

Referring to FIG. 8, after the above procedure, the multi-purpose drum 1 becomes a single-headed gone bass drum mounted on the supporting frame 22 and can produce a very low, staccato fundamental sound.

Referring to FIGS. 1-8, the outer diameter of the multi-purpose drum 1 is not limited to the exemplary embodiment. In some embodiments, the multi-purpose drum 1 has an outer diameter between 16 inches and 24 inches for a variety of uses. In one particular embodiment, the multi-purpose drum 1 has an outer diameter of 18 inches and a height of 12 inches.

The multi-purpose drum 1 provided by embodiments of the present invention includes various uses. The multi-purpose drum 1 is lightweight, convenient to carry, and easy to disassemble and install. The drummer can quickly adapt the multi-purpose drum 1 to a floor tom, a bass drum, or a gong bass drum according to needs of the performance.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A multi-purpose drum, comprising:

a cylindrical shell having an upper opening and a lower opening;

an upper drumhead for sealing the upper opening of the shell;

an upper hoop for holding the upper drumhead on the shell;

a detachable lower drumhead for sealing the lower opening of the shell;

a detachable lower hoop for holding the lower drumhead on the shell;

three brackets fixed with an outer periphery surface of the shell;

three detachable floor tom legs, each floor tom leg being optionally mounted to one of the three brackets to adapt the multi-purpose drum to a floor tom;

two detachable bass drum legs and a detachable supporting pedestal, wherein the shell is optionally pushed down, the two bass drum legs are optionally coupled with two of the three brackets, and the supporting pedestal is optionally coupled to the upper hoop to adapt the multi-purpose drum to a bass tom; and a detachable supporting frame, wherein two of the three brackets are optionally coupled to the supporting frame, and the lower drumhead and the lower hoop are optionally detached from the shell to adapt the multi-purpose drum to a gong bass drum.

2. The multi-purpose drum as recited in claim 1, wherein each of the three brackets comprises:

a base being fixed with the shell;

a cover being pivoted to the base, wherein the supporting frame, one of the three floor tom legs, or one of the two base drum legs is sandwiched between the base and the cover.

3. The multi-purpose drum as recited in claim 2, wherein:

the base comprises:

a pivot support having a pivot hole;

a first groove;

a fixing hole;

a cover-fixing member having a thread disposed in the fixing hole; and the cover comprises:

an upper pivot support having an upper pivot hole;

a lower pivot support having a lower pivot hole, the pivot support being located between the upper pivot support and the lower pivot support;

a pivot shaft passing through the upper pivot hole, the pivot hole, and the lower pivot hole;

a second groove corresponding to the first groove, wherein the supporting frame, one of the three floor tom legs, or one of the two base drum legs is sandwiched between the first groove and the second groove;

a through hole; and a nut, the cover-fixing member passing through the through hole and engaging with the nut.

4. The multi-purpose drum as recited in claim 3, wherein the nut comprises a wing nut.

5. The multi-purpose drum as recited in claim 3, wherein each of the bracket further comprises a spring disposed on a periphery of the cover-fixing member and disposed between the fixing hole and the cover.

6. The multi-purpose drum as recited in claim 1, further comprising a detachable cymbal support rod and a detachable cymbal, wherein when the multi-purpose drum is used as a bass drum, two of the three brackets are connected with the two bass drum legs, and the other bracket is connected with the cymbal support rod, which then is connected with the cymbal.

7. The multi-purpose drum as recited in claim 6, wherein the cymbal support rod comprises a cymbal support fixing portion and a cymbal support bending portion, and wherein the cymbal support fixing portion is fixed with the corresponding bracket, and the cymbal support bending portion couples with the cymbal.

8. The multi-purpose drum as recited in claim 1, wherein the supporting pedestal comprises:

a foundation;

a junction structure being connected with the foundation and being fixed with the upper hoop; and a connecting fastener being fixed with the junction structure.

9. The multi-purpose drum as recited in claim 1, wherein the upper hoop comprises a notch, and the supporting pedestal is embedded in the notch.

10. The multi-purpose drum as recited in claim 1, wherein each of the two bass drum legs comprises a straight portion and a bent portion, and wherein the straight portion is fixed with the corresponding bracket, and a terminal of the bent portion includes a tip to contact the ground.

* * * * *